US005727982A

United States Patent [19]

Hurt

[11] Patent Number: 5,727,982

[45] Date of Patent: Mar. 17, 1998

[54] ACTION FIGURE WITH ROTATING ARM MECHANISM

[75] Inventor: Steven K. Hurt, Amelia, Ohio

[73] Assignee: Hasbro, Inc., Pawtucket, R.I.

[21] Appl. No.: 631,546

[22] Filed: Apr. 12, 1996

[51] Int. Cl.[6] ..... A63H 3/20

[52] U.S. Cl. ..... 446/352; 446/241; 446/334

[58] Field of Search ..... 446/236, 241, 446/246, 330, 333, 334, 335, 352, 355

[56] References Cited

U.S. PATENT DOCUMENTS

| | | | |
|---|---|---|---|
| 1,382,708 | 6/1921 | Zaiden . | |
| 3,264,779 | 8/1966 | Bonanno . | |
| 3,475,853 | 11/1969 | Adler | 446/330 |
| 3,700,384 | 10/1972 | Gardel et al. . | |
| 3,955,311 | 5/1976 | Lyons et al. | 446/335 |
| 4,052,813 | 10/1977 | Crain et al. | 446/352 |
| 4,069,613 | 1/1978 | Lemelson et al. . | |
| 4,571,206 | 2/1986 | Mayer et al. | 446/330 |
| 4,579,542 | 4/1986 | Mayer et al. | 446/330 |
| 4,596,532 | 6/1986 | Cook et al. | 446/330 |
| 4,601,672 | 7/1986 | Cook et al. | 446/330 |
| 4,605,382 | 8/1986 | Cook et al. | 446/330 |
| 4,608,026 | 8/1986 | Newton et al. | 446/330 |
| 4,723,932 | 2/1988 | Kelley et al. | 446/330 |
| 4,952,189 | 8/1990 | Barlow | 446/241 |
| 5,087,219 | 2/1992 | Price | 446/336 |
| 5,224,896 | 7/1993 | Terzian | 446/355 |
| 5,416,995 | 5/1995 | Teng | 446/354 |

FOREIGN PATENT DOCUMENTS

| | | | |
|---|---|---|---|
| 1009558 | 5/1952 | France | 446/352 |

*Primary Examiner*—Robert A. Hafer
*Assistant Examiner*—Jeffrey D. Carlson
*Attorney, Agent, or Firm*—Marshall, O'Toole, Gerstein, Murray & Borun

[57] ABSTRACT

The action figure disclosed includes a mechanism for rotating an armor other appendage relative to its torso. The arm is activated by pivoting one leg toward another against the bias of a spring to pivot an internal lever that imparts linear movement in a follower. The follower includes a cam for engaging helical ribs on an arm shaft to translate linear motion of the follower to rotary motion in the arm shaft and arm. A ratchet on the follower prevents engagement with the lever while the spring returns the leg and internal lever back to their original positions to permit substantially continuous rotary movement of the follower.

9 Claims, 3 Drawing Sheets

ACTION FIGURE WITH ROTATING ARM MECHANISM

This invention relates generally to action Figures having movable limbs, and more particularly to an action figure with a free-spinning arm that rotates in response to one of its legs being pivoted.

BACKGROUND OF THE INVENTION

Action figures and dolls are known which have limbs that move in a variety of directions in response to a variety of internal mechanical movements. For example, Lemelson et al. U.S. Pat. No. 4,069,613 and Newton et al. U.S. Pat. No. 4,608,026 both disclose figures which have arms that pivot about their torsos. Lemelson et al. discloses an arm that pivots in response to pushing a button in the back of a doll and Newton et al. discloses an arm that pivots in response to one leg being squeezed toward the other. Both of these figures' arms reciprocate back and forth through an arc in response to the button or leg being squeezed and released. Neither is designed to spin the arm through a complete rotation or continue to spin relatively freely as the button or leg is squeezed repeatedly.

It is desirable to have an action figure with a rotating arm that can spin accessories such as weapons to simulate a fighting action.

SUMMARY OF THE INVENTION

The present invention provides an action figure with a rotating arm to provide unique play value. The action figure includes a torso defining a hollow space; a leg pivotally mounted on the torso; a lever disposed in the hollow space of the torso, the lever having a first end including a pawl and a push arm spaced apart to define a yoke space, and a second end joined to the leg; biasing means for biasing the lever and the leg in a first direction; a follower having a disk disposed in the yoke space, the disk having a first face for engagement by the pawl for linear movement in a first direction and a second face for engagement by the push arm for linear movement in a second direction, the follower also including a cam and defines a bore therethrough; an arm shaft disposed in the follower bore and having a helical rib for engagement by the cam to translate linear movement of the follower in the first direction into rotational movement in the arm shaft; and an arm fixed to the arm shaft for rotation therewith.

There may be included a second leg toward which the pivoting leg is squeezed and the biasing means may be a torsion spring. The follower may include a tube fixed to the disk to define the bore through which the arm shaft extends to improve stability in the translation of linear movement in the follower to rotational movement in the arm shaft.

The invention is also directed to a figure having a shell defining an internal space; an activator operatively disposed in the internal space of the shell; reciprocating means joined to the activator and mounted in the internal space of the shell, for moving in response to operation of the activator; a shaft rotatably mounted in the internal space of the shell; means for translating movement of the reciprocating means to rotatory movement of the shaft; and an appendage fixed to the shaft for rotation therewith.

The activator for the figure may include a second appendage pivotally mounted on the shell. The reciprocating means may include a lever disposed in the shell, having a first end and a second end, the first end having a push arm and a pawl spaced apart to define a yoke space; and a follower disposed at least partially in the yoke space, having a ratchet for engaging the pawl for linear movement in a first direction and a push surface for engaging the push arm for linear movement in a second direction.

The figure's means for translating movement of the reciprocating means to rotary motion of the shaft may include: helical ribs fixed to the shaft for rotation therewith; and a cam fixed to the reciprocating means for sliding engagement with the helical rib.

DETAILED DESCRIPTION OF THE DRAWINGS

To the extent practical, the same numerals will be used in the various figures to identify the same element of the action figure.

Figure 1:
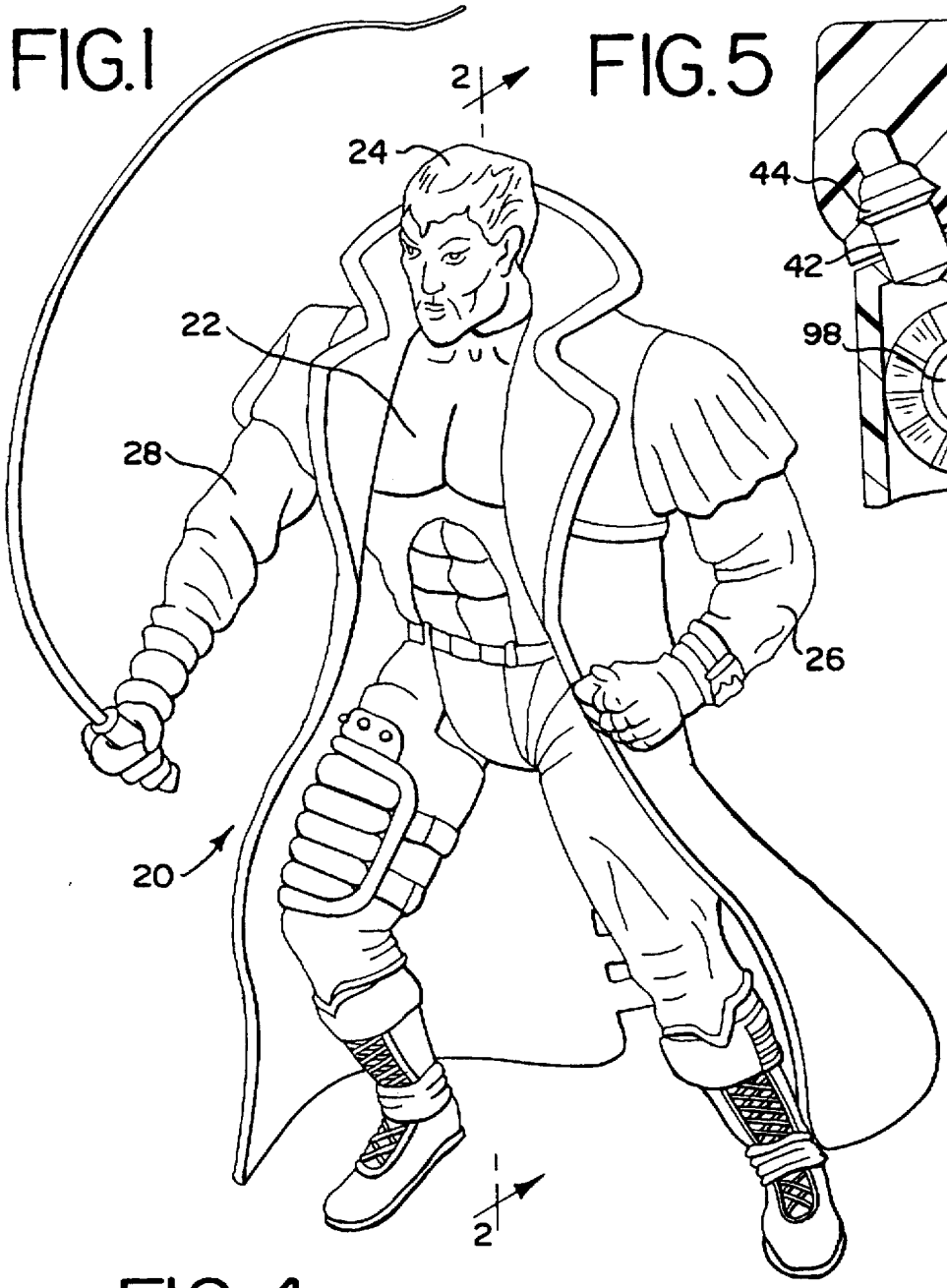
FIG. 1 is a perspective view of an action figure in accordance with the present invention.
Figure 5:
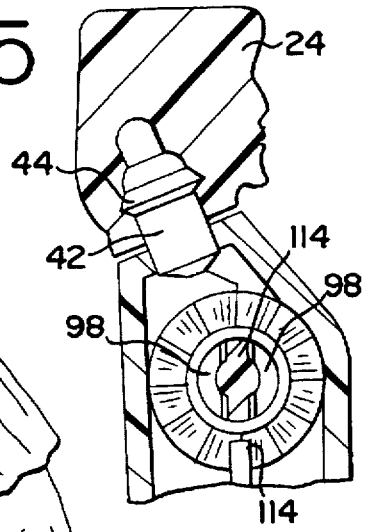
FIG. 5 is a cross-section taken along line 5—5 in FIG. 3.

Illustrated in FIG. 1 is an action FIG. 20 in accordance with the present invention. The action figure 20 includes a hollow torso 22, a head 24, a left arm 26, a right arm 28, a left leg 30, and a right leg 32. The action figure can be in any shape, style, or gender, and have various accessories to enhance play value. Further, the feet may define sockets 33 for friction-fitting on pegs extending upward from other accessories.

Figure 2:
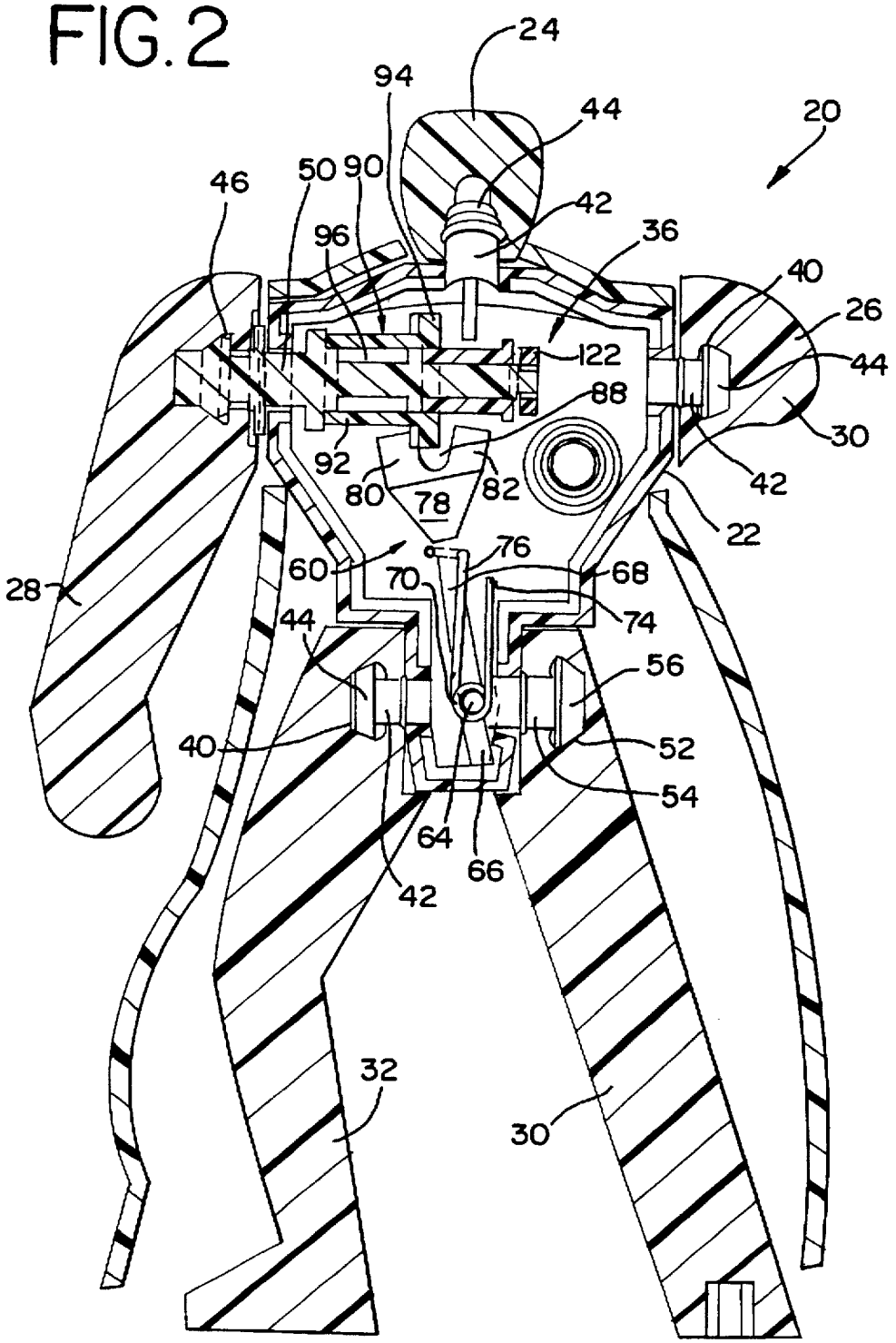
FIG. 2 is a cross-sectional view of the action figure as viewed from line 2—2 in FIG. 1 exposing an arm rotating mechanism in accordance with the present invention.
Figure 3:
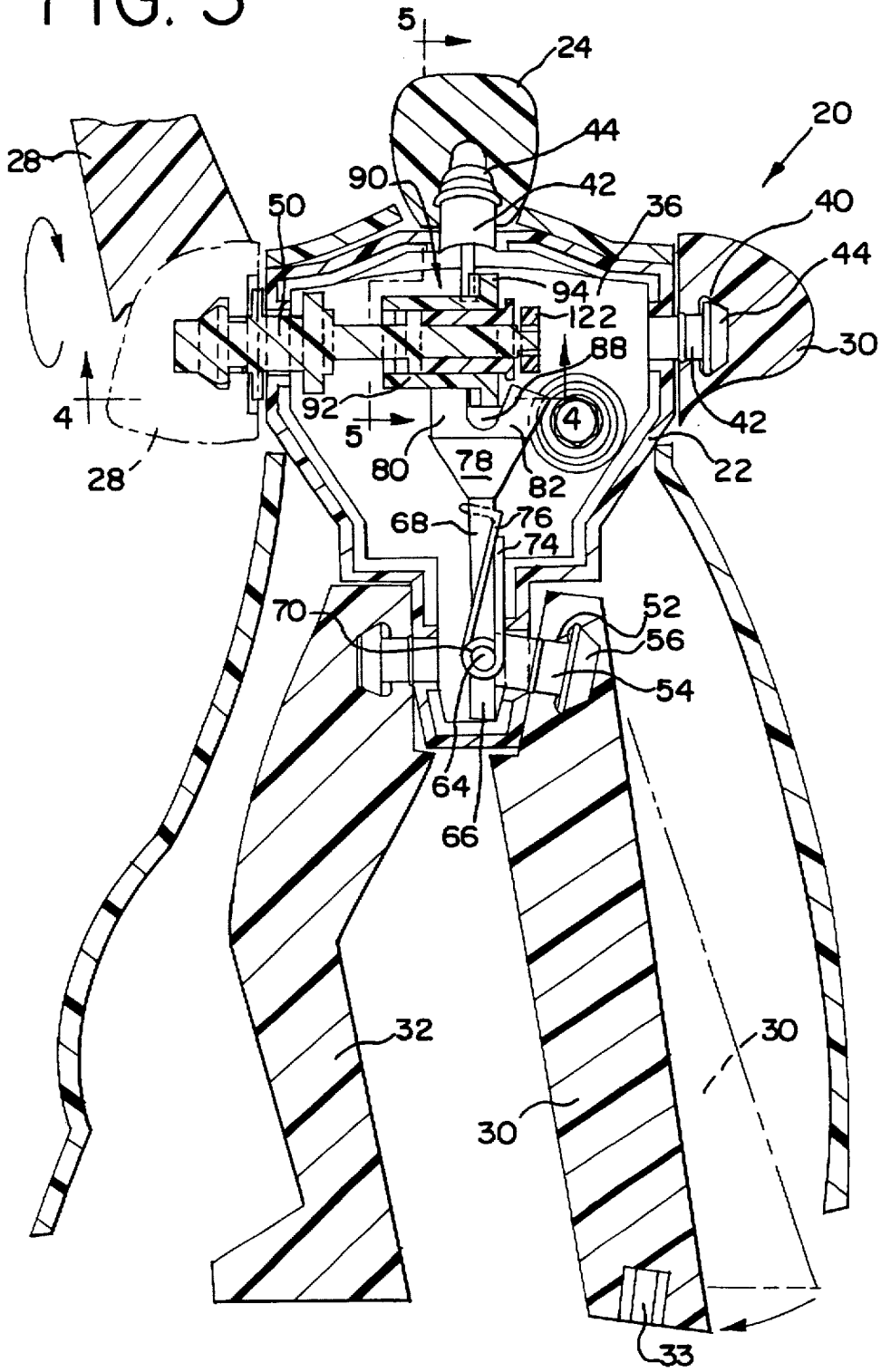
FIG. 3 is the cross-sectional view of FIG. 2 with the left leg pivoted and the arm shaft and arm rotating.

In FIGS. 2 to 5 features generally mounted on the inside of the torso 22 are depicted. In FIGS. 2 and 3, an internal arm rotating mechanism 36 is visible and it is apparent that the head 24, left arm 26, and right leg 32 are all pivotally joined to the torso 22 using sockets 40 and mushroom-shaped posts 42. The posts 42 include enlarged heads 44 that snap into the sockets 40 in a known manner.

The right arm 28 includes a socket 46 that receives a shaft 50. The fit between the right arm socket 46 and the shaft 50 is tight and rotation of the shaft 50 will be transferred to the right arm 28 directly with negligible slippage.

The left leg 30 includes a socket 52 and a post 54 that are engaged so that the left leg 30 can rotate relative to the post 54, but the post 54 includes an oversized head 56 to transfer greater force and prevent the head 56 from pulling out of the socket 52 when the left leg 30 is squeezed toward the right leg 32 so that the left leg 30 pivots about the lower edge of the torso 22 as illustrated in FIG. 3 with the phantom lines. In this embodiment, the left leg 30 is part of an activator for the arm rotating mechanism 36.

The left leg post 54 extends into the hollow torso 22 and is fixed to a lever 60. The lever 60 is disposed in the torso 22. The upper portion of the lever 60 defines a lever first end 68 and the lower portion of the lever 60 the defines a lever second end 66. The left leg post 54 is joined to the lever 60 at a location that will result in the lever 60 pivoting clockwise when the left leg 30 is pivoted toward the right leg 32 as depicted in FIG. 3.

The left leg 30 is typically in its normal position (away from the right leg 32 as depicted in FIG. 2) due to the biasing of torsion spring 70 which is mounted on lever pin 64. The torsion spring 70 includes a central winding mounted on the lever pin 64, a passive end 74 bearing on an interior surface of the torso 22, and an active end 76 wrapped around the first end 66 of the lever 60. In this manner, the torsion spring 70 biases the lever in a counter-clockwise direction and, consequently, the left leg 30 is biased away from the right leg 32.

The first end 66 of the lever 60 includes a bifurcated portion 78, having a pawl 80 and a push arm 82. The pawl 80 is tapered inward and the push arm 82 has a smooth inner surface. The pawl 80 and the push arm are spaced apart to define a yoke space 88.

Positioned at least partially in the yoke space 88 is a follower 90. The follower 90 includes a cylinder 92 on the right fixed to a disk 94 on the left. Both the cylinder 92 and the disk 94 define a central bore 96. The disk 94 extends into the yoke space 88 and includes a crown ratchet 100 formed integrally with the right radial face of the disk 94. The crown ratchet 100 includes a plurality of teeth 102 that can be engaged by the tapered pawl 80 on the lever 60. The left radial face 104 of the disk 94 is a smooth surface that can be slidably engaged by the smooth push arm 82 on the lever 60. Inside the bore, are a pair of opposing cams 98.

Figure 4:
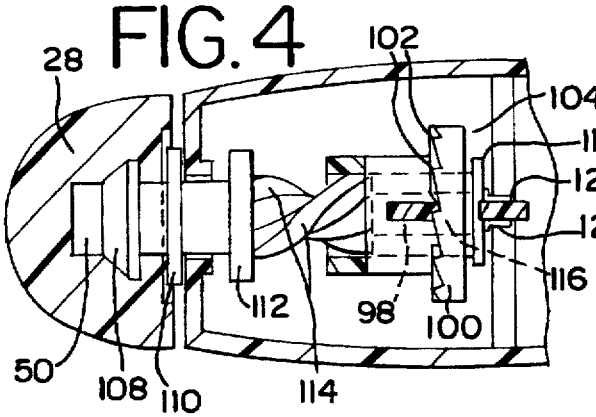
FIG. 4 is a cross-section of the arm shaft and follower of FIG. 3 taken along line 4—4.
Figure 4A:
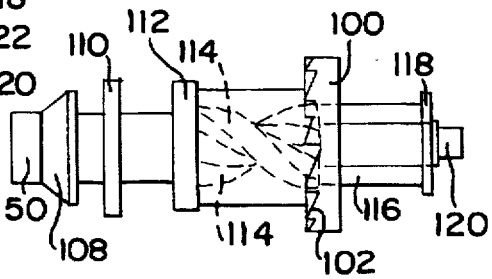
FIG. 4A is the cross-section of FIG. 4 with the follower and arm shaft at rest.

Disposed in the follower bore 96 is the shaft 50 of the right arm 28. As best illustrated in FIGS. 4 and 4A, the shaft 50 includes an enlarged head 108, a spacer 110 for maintaining the right arm 28 away from the torso 22, a collar 112, a pair of helical ribs 114, for engagement with the cams 98, a smooth cylindrical portion 116, and a trunnion 118 for being supported in a bearing 120 that is preferably formed integrally with the torso 22.

The follower cams 98 are positioned between the helical ribs 114 of the arm shaft 50. In this configuration it should be understood that by pivoting the left leg 30 toward the right leg 32, the lever 60 will be pivoted clockwise, as illustrated, to move the follower 90 linearly toward the left arm 30 and engage the pawl 80 with one of the teeth 102 on the crown ratchet 100. As the lever 60 continues to pivot clockwise, the follower 90 will move linearly and without rotating due to the engagement of the pawl 80 with a tooth 102 on the crown ratchet 100. As the follower 90 moves toward the left arm 30, the cams 98 will engage the helical ribs 114 on the arm shaft 50, and translate the linear movement of the follower 90 into rotary movement in the arm shaft 50 and right arm 28.

As the follower 90 moves toward the stop collar 118, the lever 60 will pivot until it engages the inside of the torso 22 and the pawl 80 will become disengaged from the crown ratchet 100 and the right arm 28 and the arm shaft 50 will continue spinning due to their combined inertia. Because the cams 98 are still positioned between the helical ribs 114, the follower 90 will be forced into rotation at the same rate as the arm shaft 50. Further, the stop collar 118 is spaced to provide for over-travel of the follower 90 toward the left arm 26 as a result of its momentum which provides a free-spinning space where the lever 60 is not in contact with the follower 90 at all. Even if the pawl 80 were to engage the crown ratchet 100 the ratchet teeth 102 will not be engaged due to their ramped sides facing the pawl 80 when the follower 90 is rotating.

When the left leg 30 is released, the torsion spring 70 urges the lever 60 in a counter-clockwise direction resulting in the push arm 82 slidably bearing on the second face 104 of the follower disk 94 to push the follower 90 back to the right. Although some friction force will be applied, the follower 90, arm shaft 50, and right arm 28 will continue spinning until gravity acting on the right arm 28 and frictional forces in the mechanism 36 stop the arm 28.

By continually pumping the left leg 30, the follower 90 will reciprocate back and forth and the right arm 28 will continue to spin at a near constant rate because the arm 28 barely slows down in the time it takes for the left leg 30 to pivot away from the right leg 32 when the mechanism 26 is ready for another operation.

As illustrated in FIG. 2, the pawl 80 engages the crown ratchet 100 when the left leg 30 is in its normal position to restrict right arm 28 movement. Alternatively, the lever 60 may be designated so that the push arm 82 engages the smooth face of the follower disk 94 for easier movement of the right arm 28 when the left leg 30 is not being activated.

It will be understood by those skilled in the art that the pivoting leg can be either the right or left leg, and that the pivoting element can be a leg, as illustrated, or any other appendage. Likewise, the rotating arm can be the right or left arm or it can be replaced by other desired appendages.

The above detailed description is for clearness of understanding only and no unnecessary limitations in the claims should be inferred therefrom.

What is claimed is:

1. An action figure with a rotating arm, comprising:

a torso defining a hollow space;

a leg pivotally mounted on the torso;

a lever disposed in the hollow space of the torso, the lever having a first end and a second end, the first end including a pawl and a push arm spaced apart to define a yoke space, and the second end is joined to the leg for being moved in a first direction;

biasing means for biasing the lever in a second direction;

a follower having a cam and a disk fixed to the cam, the disk at least partially disposed in the yoke space of the lever, the disk having a first face defining a crown ratchet for being engaged by the pawl and a second face for being engaged by the push arm, and the follower defining a bore therethrough;

an arm shaft rotatably joined to the torso and disposed in the bore of the follower and having a helical rib for engagement with the follower cam to translate linear movement of the follower into rotational movement of the arm shaft; and an arm fixed to the arm shaft for rotation therewith.

2. The action figure of claim 1 in which the leg pivots toward a second leg mounted on the torso.

3. The action figure of claim 1 in which the biasing means is a torsion spring.

4. The action figure of claim 1 in which the follower further comprises:

a tube fixed to the disk and defining the bore, and the cam is mounted in the bore.

5. A figure with a rotating appendage, comprising:

a shell defining an internal space;

an activator operatively mounted to the shell;

reciprocating means joined to the activator and mounted in the internal space of the shell, for moving in response to operation of the activator;

a shaft rotatably mounted in the internal space of the shell;

means for translating movement of the reciprocating means to free rotational movement of the shaft, the shaft capable of rotation independant of the reciprocating means, and an appendage fixed to the shaft for free rotation therewith.

6. The figure of claim 5 in which the activator is a second appendage pivotally joined to the shell.

7. A figure with a rotating appendage, comprising:

a shell defining an internal space;

an activator operatively mounted to the shell;

reciprocating means joined to the activator and mounted in the internal space of the shell, for moving in response to operation of the activator;

a shaft rotatably mounted in the internal space of the shell;

means for translating movement of the reciprocating means to free rotational movement of the shaft; and an appendage fixed to the shaft for rotation therewith and wherein the reciprocating means comprises:

a lever disposed in the shell, having a first end and a second end, the first end having a push arm and a pawl spaced apart to define a yoke space; and a follower disposed at least partially in the yoke space, having a ratchet for engaging the pawl for linear movement in a first direction and a push surface for engaging the push arm for linear movement in a second direction.

8. The figure of claim 5 in which the means for translating movement of the reciprocating means to rotary movement of the shaft comprises:

a helical rib fixed to the shaft for rotation therewith; and a cam fixed to the reciprocating means for sliding engagement with the helical rib.

9. The figure of claim 5 in which the appendage is an arm of an action figure.

* * * * *